US010246765B2

(12) United States Patent
Omura et al.

(10) Patent No.: US 10,246,765 B2
(45) Date of Patent: Apr. 2, 2019

(54) MARTENSITIC CR-CONTAINING STEEL AND OIL COUNTRY TUBULAR GOODS

(71) Applicant: NIPPON STEEL & SUMITOMO METAL CORPORATION, Tokyo (JP)

(72) Inventors: Tomohiko Omura, Kishiwada (JP); Yusaku Tomio, Nishinomiya (JP); Hideki Takabe, Osaka (JP); Toshio Mochizuki, Osaka (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 329 days.

(21) Appl. No.: 15/109,139

(22) PCT Filed: Dec. 24, 2014

(86) PCT No.: PCT/JP2014/006435

§ 371 (c)(1),
(2) Date: Jun. 30, 2016

(87) PCT Pub. No.: WO2015/107608

PCT Pub. Date: Jul. 23, 2015

(65) Prior Publication Data

US 2016/0326617 A1 Nov. 10, 2016

(30) Foreign Application Priority Data

Jan. 17, 2014 (JP) ..... 2014-007201

(51) Int. Cl.

| | |
|---|---|
| ***C22C 38/22*** | (2006.01) |
| ***C22C 38/24*** | (2006.01) |
| ***C22C 38/26*** | (2006.01) |
| ***C22C 38/28*** | (2006.01) |
| ***C21D 8/10*** | (2006.01) |
| ***C21D 9/14*** | (2006.01) |
| ***E21B 17/00*** | (2006.01) |
| ***C22C 38/54*** | (2006.01) |
| ***C21D 6/00*** | (2006.01) |
| ***C22C 38/00*** | (2006.01) |
| ***C22C 38/32*** | (2006.01) |
| ***C22C 38/02*** | (2006.01) |
| ***C22C 38/04*** | (2006.01) |
| ***C22C 38/06*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/18*** | (2006.01) |
| ***C21D 1/22*** | (2006.01) |
| *C21D 9/08* | (2006.01) |

(52) U.S. Cl.

CPC ..... *C22C 38/54* (2013.01); *C21D 1/22* (2013.01); *C21D 6/002* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/18* (2013.01); *C22C 38/22* (2013.01); *C22C 38/24* (2013.01); *C22C 38/26* (2013.01); *C22C 38/28* (2013.01); *C22C 38/32* (2013.01); *C22C 38/44* (2013.01); *C22C 38/46* (2013.01); *C22C 38/48* (2013.01); *C22C 38/50* (2013.01); *E21B 17/00* (2013.01); *C21D 8/105* (2013.01); *C21D 9/085* (2013.01); *C21D 2201/05* (2013.01); *C21D 2211/001* (2013.01); *C21D 2211/005* (2013.01); *C21D 2211/008* (2013.01)

(58) Field of Classification Search

None

See application file for complete search history.

(56) References Cited

U.S. PATENT DOCUMENTS 2,905,577 A * 9/1959 Harris ..... C22C 38/18 148/325

FOREIGN PATENT DOCUMENTS

| | | |
|---|---|---|
| CN | 1826202 | 8/2006 |
| CN | 1914343 | 2/2007 |
| CN | 101076612 | 11/2007 |
| JP | 06-025746 | 2/1994 |
| JP | 07-076722 | 3/1995 |

(Continued)

OTHER PUBLICATIONS

Machine-English translation of JP 07076722 A, Sakamoto Toshiharu et al., Mar. 20, 1995.*

Huang et al., "Corrosion Resistance . . . Data of Materials", Chemical Industry Press, Jan. 2003, p. 126, with partial English translation.

Ren et al., "Corrosion and Control of Pressure Vessels", Chemical Industry Press, Aug. 2003, pp. 492-495, with partial English translation.

Zhong, "Diagnosis, Prediction . . . Material Aging", Central South University Press, Feb. 2009, p. 309, with partial English translation.

Yang et al., "Mechanical Behavior of Materials", Chemical Industry Press, Aug. 2009, p. 192, with partial English translation.

(Continued)

*Primary Examiner* — Deborah Yee

(74) *Attorney, Agent, or Firm* — Clark & Brody

(57) ABSTRACT

A martensitic Cr-containing steel having excellent corrosion resistance, SSC resistance, and IGHIC resistance is provided. A martensitic Cr-containing steel according to the present invention includes: a chemical composition consisting of, by mass %, Si: 0.05 to 1.0%, Mn: 0.1 to 1.0%, Cr: 8 to 12%, V: 0.01 to 1.0%, sol. Al: 0.005 to 0.10%, with the balance being Fe and impurities, wherein an effective Cr amount defined by "Cr−16.6×C" is not less than 8%, and an Mo equivalent defined by "Mo+0.5×W" is 0.03 to 2%; a micro-structure wherein a grain size number of prior-austenite crystal grain is not less than 8.0; and a yield strength of less than 379 to 551 MPa, wherein a grain-boundary segregation ratio of Mo and W is not less than 1.5.

16 Claims, No Drawings

(56) References Cited

FOREIGN PATENT DOCUMENTS

JP 2000-063994 2/2000

OTHER PUBLICATIONS

Liu, "Material Corrosion and Control Engineering", Peking University Press, Jul. 2010, p. 81, with partial English translation.
Takahiro Kushida et al., "Hydrogen Embrittlement . . . Hydrogen Absorption", Materia, The Japan Institute of Metals and Materials, vol. 33, No. 7, p. 932-939, 1994.
Sorokin V.G., Steel and Alloys, Grade Guide, Moscow, Internet Engineering, 2001, p. 10 with its English translation.

* cited by examiner

MARTENSITIC CR-CONTAINING STEEL AND OIL COUNTRY TUBULAR GOODS

TECHNICAL FIELD

The present invention relates to a Cr-containing steel and steel pipe, and more particularly to a martensitic Cr-containing steel and oil country tubular goods.

BACKGROUND ART

As used herein, the term "oil country tubular goods" refers to oil well steel pipes, for example, described in the definition column of No. 3514 of JIS G 0203 (2009). Specifically, the "oil country tubular goods (hereinafter abbreviated as OCTG)" means a general term for pipe and tube products such as casing, tubing, and drilling pipes which are used in drilling of oil wells or gas wells, and extraction of crude oil or natural gas.

As low-corrosive wells (oil wells and gas wells) have been exhausted, wells with high corrosiveness (hereafter, referred to as highly corrosive wells) has been developed. A highly corrosive well contains large amounts of corrosive substances. Examples of corrosive substance include corrosive gasses such as hydrogen sulfide and carbon dioxide gas, and the like. Hydrogen sulfide causes sulfide stress cracking (hereafter, referred to as "SSC") in high strength and low alloy OCTG. On the other hand, carbon dioxide gas deteriorates carbon dioxide gas corrosion resistance of steel. Therefore, high SSC resistance and high carbon dioxide gas corrosion resistance are required for OCTG for use in highly corrosive wells.

It is known that chromium (Cr) is effective for improving the carbon dioxide gas corrosion resistance of steel. Therefore, in wells containing a large amount of carbon dioxide gas, martensitic stainless steels containing about 13% of Cr typified by API L80 13Cr steel (Conventional 13 Cr steel) or Super 13 Cr Steel, dupulex stainless steels, and the like are used depending on the partial pressure and temperature of carbon dioxide gas.

However, in a martensitic stainless steel and a duplex stainless steel, SSC attributable to hydrogen sulfide is caused at a lower partial pressure (for example, not more than 0.1 atmosphere) compared with in a low alloy steel. Therefore, these stainless steels are not suitable for use in environments containing large amounts of hydrogen sulfide (for example, environments where the partial pressure of hydrogen sulfide is not less than 1 atmosphere).

Japanese Patent Application Publication No. 2000-63994 (Patent Literature 1) and Japanese Patent Application Publication No. 07-76722 (Patent Literature 2) propose a steel which is excellent in carbon dioxide gas corrosion resistance and SSC resistance.

Patent Literature 1 describes the following matters regarding a Cr-containing steel pipe for oil wells. The Cr-containing steel pipe for oil-wells consists of, by mass %, C: not more than 0.30%, Si: not more than 0.60%, Mn: 0.30 to 1.50%. P: not more than 0.03%, S: not more than 0.005%, Cr: 3.0 to 9.0%, and Al: not more than 0.005%, with the balance being Fe and inevitable impurities. Further, the Cr-containing steel pipe for oil-wells has a yield stress of 80 ksi class (551 to 655 MPa).

Patent Literature 1 also describes that the above described Cr-containing steel pipe for oil-wells exhibited a corrosion rate of not more than 0.100 mm/yr in a carbon dioxide gas corrosion test at a carbon dioxide gas partial pressure of 1 MPa and a temperature of 100° C. Further Patent Literature 1 describes that in a constant load Lest conforming to NACE-TM0177-96 method A, the above described steel pipe showed no SSC under an applied stress of 551 MPa in a test Solution A (pH 2.7).

Patent Literature 2 describes the following matters regarding the production method of a martensitic stainless steel for OCTG. A steel mainly composed of martensite, and containing, by mass %, C: 0.1 to 0.3%, Si: <1.0%, Mn: 0.1 to 1.0%, Cr: 11 to 14%, and Ni: <0.5% is prepared. The steel is heated to a temperature between $A_{c3}$ point and $A_{c1}$ point, and is thereafter cooled to Ms point or lower. Thereafter, the steel is heated to a temperature not more than the $A_{c1}$ point, and thereafter is cooled to ambient temperature. This production method performs a duplex region heat treatment between quenching and tempering treatments. The steel produced by this production method has a yield strength of as low as not more than 50 kgf/mm$^2$ (490 MPa, 71.1 ksi).

In general, in a carbon steel and a low alloy steel, the lower the strength, the more excellent the sulfide stress cracking resistance is, and it is considered that the same applies to the case of martensitic stainless steels. It is not possible to obtain a yield strength of steel of not more than 55 to 60 kgf/mm$^2$ (539 to 588 MPa, 78.2 to 85.3 ksi) by a conventional heat treatment method of steel (method of performing normalizing and tempering). In contrast to this, the production method according to Patent Literature 2, which involves heat treatment in a duplex region, can obtain a low yield strength. Thus, Patent Literature 2 describes that the steel obtained by this production method is excellent in the SSC resistance and the carbon dioxide gas corrosion resistance.

CITATION LIST

Patent Literature

Patent Literature 1: Japanese Patent Application Publication No. 2000-63994

Patent Literature 2: Japanese Patent Application Publication No. 07-76722

Non Patent Literature

Non patent Literature 1: Takahiro Kushida and Takeo Kudo, "Hydrogen Embrittlement in Steels from Viewpoints of Hydrogen Diffusion and Hydrogen Absorption," Materia, The Japan Institute of Metals and Materials, Vol. 33, No. 7, p. 932-939, 1994.

SUMMARY OF INVENTION

The Cr-containing steel pipe for oil wells according to Patent Literature 1 has a high yield strength. Therefore, it may have lower SSC resistance. Further, this Cr-containing steel for oil wells has a low Cr content. Therefore, it may have insufficient carbon dioxide gas corrosion resistance.

The martensitic stainless steel pipe according to Patent Literature 2 contains high-temperature tempered martensite or recrystallized ferrite, and martensite having a high carbon content. These structures have different strength. For that reason, the carbon dioxide gas corrosion resistance may be low.

It is an object of the present invention to provide a martensitic Cr-containing steel which has excellent carbon dioxide gas corrosion resistance and excellent SSC resistance.

The chemical composition of a martensitic Cr-containing steel according to the present invention consists of, by mass %, Si: 0.05 to 1.00%, Mn: 0.1 to 1.0%, Cr: 8 to 12%, V: 0.01 to 1.0%, sol. Al: 0.005 to 0.10%, N: not more than 0.100%, Nb: 0 to 1%, Ti: 0 to 1%, Zr: 0 to 1%, B: 0 to 0.01%, Ca: 0 to 0.01%, Mg: 0 to 0.01%, and rare earth metal (REM): 0 to 0.50%, further consisting of one or more selected from the group consisting of Mo: 0 to 2% and W: 0 to 4%, with the balance being Fe and impurities. The impurities include C: not more than 0.10%, P: not more than 0.03%, S: not more than 0.01%, Ni: not more than 0.5%, and O: not more than 0.01%. Further, an effective Cr amount defined by Formula (1) is not less than 8%, and an Mo equivalent defined by Formula (2) is 0.03 to 2%. The micro-structure of the above described martensitic Cr-containing steel, in which the grain size number (ASTM E112) of prior-austenite crystal grain is not less than 8.0, consists of, in volume fraction, 0 to 5% of ferrite and 0 to 5% of austenite, with the balance being tempered martensite. The above described martensitic Cr-containing steel has a yield strength of 379 to less than 551 MPa, and in which a grain-boundary segregation ratio, which is defined, when either one of Mo and W is contained, as a ratio of a maximum content at grain boundaries to an average content within grains of the contained element, and when Mo and W are contained, as an average of ratios of a maximum content at grain boundaries to an average content within grains of each element, is not less than 1.5:

$$\text{Effective Cr amount}=\text{Cr}-16.6\times\text{C} \quad (1)$$

$$\text{Mo equivalent}=\text{Mo}+0.5\times\text{W} \quad (2)$$

where, symbols of elements in Formulae (1) and (2) are substituted by corresponding contents (by mass %) of the elements.

The martensitic Cr-containing steel of the present invention has excellent carbon dioxide gas corrosion resistance and SCC resistance.

DESCRIPTION OF EMBODIMENTS

Hereafter, embodiments of the present invention will be described in detail.

The present inventors have conducted investigation and studies on the carbon dioxide gas corrosion resistance and the SSC resistance of steel, and have obtained the following findings.

(A) To improve the carbon dioxide gas corrosion resistance of steel, solid-soluble Cr in steel is effective. In a steel containing C, and not more than 13% of Cr (such as the above described Cr steel and 13Cr steel), the effective Cr amount (%) defined by Formula (1) provides an indicator of the carbon dioxide gas corrosion resistance in an environment containing high temperature carbon dioxide gas of about 100° C.:

$$\text{Effective Cr amount}=\text{Cr}-16.6\times\text{C} \quad (1)$$

where, symbols of elements in Formula (1) are substituted by corresponding contents (by mass %) of the elements.

The solid-soluble Cr content in steel decreases as a result of formation of Cr carbide ($Cr_{23}C_6$). The effective Cr amount means a Cr content which is substantially effective for carbon dioxide gas corrosion resistance.

If the effective Cr amount defined by Formula (1) is not less than 8.0%, excellent carbon dioxide gas corrosion resistance can be obtained in a highly corrosive well (oil well and gas well) having a high temperature of about 100° C.

(B) The SSC resistance of martensitic stainless steel typified by Cr steel and 13Cr steel is lower than that of carbon steel and low alloy steel. The reason of that is considered to be as follows. Solid-soluble alloying elements other than Fe, such as Cr, Mn, Ni, and Mo decrease the hydrogen diffusion coefficient D of steel. The hydrogen diffusion coefficient D ($m^2/s$) is an indicator that shows the ease of diffusion of hydrogen in steel. As the hydrogen diffusion coefficient D decreases, the amount of hydrogen absorbed in steel increases in an environment containing hydrogen sulfide and thereby SSC becomes more likely to occur. Steel contains an amount of hydrogen in proportion to an inverse of the hydrogen diffusion coefficient (1/D) depending on environments. This finding is disclosed in Non Patent Literature 1.

In short, as the content of a solid-soluble alloying element such as Cr, Mn, Ni and Mo increases, the larger amount of hydrogen is absorbed in steel so that hydrogen embrittlement becomes more likely to occur. Therefore, the SSC resistance of a steel containing an effective Cr amount of not less than 8.0% may be deteriorated.

(C) Cr content shall be not more than 12% in a martensitic Cr-containing steel containing an effective Cr amount of not less than 8.0%. Further, the contents of Mn, P, S and Ni which impair the suppression of the occurrence of SSC shall be decreased and the yield strength shall be less than 80 ksi (551 MPa). As a result, excellent SSC resistance will be obtained.

(D) The micro-structure shall be substantially a single phase of tempered martensite. This will improve the SSC resistance, and further such homogeneous structure makes it easier to adjust the strength. When ferrite and residual austenite are present in the micro-structure, the contents thereof shall be respectively not more than 5% in volume %, and are preferably as low as possible.

(E) As in the above described (B) to (D), adjusting Cr content, reducing the strength, and optimizing the micro-structure are effective for improving the SSC resistance. However, it has been found that when a steel whose Cr content and effective Cr amount satisfy the above described specifications is used in an environment comparative to a highly corrosive well, cracking still occurs. As a result of investigating on this point, the present inventors have newly found that hydrogen brittlement of intergranular cracking type, which has not been observed before in any conventional material, occurs in the above described steel. This phenomenon will be herein referred to as intergranular hydrogen induced cracking (IGHIC).

The characteristic features of IGHIC are the following two points. (i) An intergranular crack progresses to a length of more than 1 mm. (ii) Intergranular cracking occurs and progresses even under no applied stress.

The occurrence mechanism of IGHIC is considered as follows. The steel specified in (B) to (D) has a low strength. Therefore, it is likely to yield to the hydrogen pressure. Further, in the steel specified in (B) to (D), the Cr content is higher compared with in a low alloy steel. For that reason, its hydrogen diffusion coefficient is small and a larger amount of hydrogen is likely to be absorbed. In addition, in the steel specified in (B) to (D), susceptibility to hydrogen cracking which starts from Cr carbide ($Cr_{23}C_6$) precipitated at grain boundaries, increases, and the strength of grain boundaries is decreased due to grain-boundary segregation of P and S. As a result, susceptibility to hydrogen cracking increases as a whole, and IGHIC becomes more likely to occur.

(F) To suppress the occurrence of IGHIC, it is effective that C content of steel is not more than 0.1%, and that a minute amount of one or two selected from the group consisting of Mo and W (hereafter, also referred to as Mo analogues) is contained. It is considered that reducing C content decreases the amount of Cr carbide ($Cr_{23}C_6$) formed at grain boundaries, which acts as an initiation site of IGHIC. It is also considered that incorporating Mo analogues causes segregation of Mo analogues at grain boundaries during tempering, and the segregated Mo analogues suppress segregation of P.

(G) As described above, incorporating Mo analogues will suppress the occurrence of IGHIC, thus improving the SSC resistance. When the C content is not more than 0.1% in a steel whose Cr content and effective Cr amount satisfy the above described specifications, Mo equivalent (%) defined by below described Formula (2) will be an indicator for the IGHIC resistance and SSC resistance:

$$\text{Mo equivalent}=\text{Mo}+0.5\times\text{W} \quad (2)$$

where, symbols of elements in Formula (2) are substituted by corresponding contents (by mass %) of the elements.

When the Mo equivalent defined by Formula (2) is not less than 0.03%, it is possible to suppress the occurrence of IGHIC, and to achieve excellent SSC resistance. It is considered that such achievement of excellent SSC resistance is attributable to the fact that IGHIC near the surface acts as an initiation site of SSC.

Mo analogues decrease the hydrogen diffusion coefficient D of steel. However, the improving effect of SSC resistance by incorporating Mo analogues is more significant than the deteriorating effect of SSC resistance by decreasing the hydrogen diffusion coefficient D. Therefore, when the Mo equivalent is not less than 0.03%, it is possible to suppress the occurrence of IGHIC, achieving excellent SSC resistance.

(H) An element (for example, V) which has a stronger carbide forming ability than that of Cr may be contained. In this case, the occurrence of IGHIC will be suppressed. Such an element also has an effect of forming fine carbide, an effect of improving the resistance to temper softening, and an effect of increasing grain-boundary segregation of Mo analogues.

(I) Refining prior-austenite grain size will suppress the occurrence of IGHIC. Specifically, when the grain size number (ASTM E112) of prior-austenite crystal grain is not less than 8.0, the occurrence of IGHIC will be suppressed. Refining the prior-austenite grain size increases the area of grain boundary, thus suppressing accumulation of hydrogen. As a result, the occurrence of IGHIC is suppressed.

The chemical composition of the martensitic Cr-containing steel according to the present invention, which has been completed based on the above described findings, consists of, by mass %, Si: 0.05 to 1.00%, Mn: 0.1 to 1.0%, Cr: 8 to 12%, V: 0.01 to 1.0%, sol. Al: 0.005 to 0.10%, N: not more than 0.100%, Nb: 0 to 1%, Ti: 0 to 1%, Zr: 0 to 1%, B: 0 to 0.01% Ca: 0 to 0.01%, Mg: 0 to 0.01%, and rare earth metal (REM): 0 to 0.50%, further consisting of one or two selected from the group consisting of Mo: 0 to 2% and W: 0 to 4%, with the balance being Fe and impurities. The impurities include C: not more than 0.10%, P: not more than 0.03%, S: not more than 0.01%, Ni: not more than 0.5%, and O: not more than 0.01%. Further, effective Cr amount defined by Formula (1) is not less than 8%, and Mo equivalent defined by Formula (2) is 0.03 to 2%. The micro-structure of the above described martensitic Cr-containing steel consists of, in volume fraction, 0 to 5% of ferrite and 0 to 5% of austenite, with the balance being tempered martensite, in which the grain size number (ASTM E112) of prior-austenite crystal grain is not less than 8.0. The above described martensitic Cr-containing steel has a yield strength of 379 to less than 551 MPa, and in which a grain-boundary segregation ratio, which is defined, when either one of Mo and W is contained, as a ratio of a maximum content at grain boundaries to an average content within grains of the contained element, and when Mo and W are contained, as an average of ratios of a maximum content at grain boundaries to an average content within grains of each element, is not less than 1.5.

$$\text{Effective Cr amount}=\text{Cr}-16.6\times\text{C} \quad (1)$$

$$\text{Mo equivalent}=\text{Mo}+0.5\times\text{W} \quad (2)$$

where, symbols of elements in Formulae (1) and (2) are substituted by corresponding contents (by mass %) of the elements.

The chemical composition of the above described martensitic Cr-containing steel may contain one or more selected from the group consisting of Nb: 0.01 to 1%, Ti: 0.01 to 1%, and Zr: 0.01 to 1%.

The chemical composition of the above described martensitic Cr-containing steel may contain B: 0.0003 to 0.01%.

The chemical composition of the above described martensitic Cr-containing steel may contain one or more selected from the group consisting of Ca: 0.0001 to 0.01%, Mg: 0.0001 to 0.01%, and REM: 0.0001 to 0.50%.

OCTG according to the present invention are produced by using the above described martensitic Cr-containing steel.

Hereafter, the martensitic Cr-containing steel according to the present invention will be described in detail. The symbol "%" in the content of each element means "mass %".

[Chemical Composition]

The chemical composition of a martensitic Cr-containing steel according to the present invention contains the following elements.

Si: 0.05 to 1.00%

Silicon (Si) deoxidizes steel. If the Si content is too low, the effect cannot be achieved. On the other hand, if the Si content is too high, the effect is saturated. Therefore, the Si content is 0.05 to 1.00%. The lower limit of the Si content is preferably 0.06%, more preferably 0.08%, and further more preferably 0.10%. The upper limit of the Si content is preferably 0.80%, more preferably 0.50%, and further more preferably 0.35%.

Mn: 0.1 to 1.0%

Manganese (Mn) increases the hardenability of steel. If the Mn content is too low, the effect cannot be achieved. On the other hand, if the Mn content is too high, Mn, along with impurity elements such as P and S, segregates at grain boundaries. In this case, the SSC resistance and the IGHIC resistance will be deteriorated. Therefore, the Mn content is 0.1 to 1.0%. The lower limit of the Mn content is preferably 0.20%, more preferably 0.25%, and further more preferably 0.30%. The upper limit of the Mn content is preferably 0.90%, more preferably 0.70%, and further more preferably 0.55%.

Cr: 8 to 12%

Chromium (Cr) improves the carbon dioxide gas corrosion resistance of steel. If the Cr content is too low, this effect cannot be achieved. On the other hand, if the Cr content is too high, the hydrogen diffusion coefficient D is significantly reduced, and the SSC resistance is deteriorated. Therefore, the Cr content is 8 to 12%. The lower limit of the Cr content is preferably 8.2%, more preferably 8.5%, further more preferably 9.0%, and further more preferably 9.1%. The upper limit of the Cr content is preferably 11.5%, more preferably 11%, and further more preferably 10%.

In the above described martensitic Cr-containing steel, the effective Cr amount defined by Formula (1) is not less than 8.0%:

$$\text{Effective Cr amount}=\text{Cr}-16.6\times\text{C} \quad (1)$$

where, symbols of elements in Formula (1) are substituted by corresponding contents (by mass %) of the elements.

The effective Cr amount means a Cr content which is substantially effective for carbon dioxide gas corrosion resistance. If the effective Cr amount defined by Formula (1) is not less than 8.0%, excellent carbon dioxide gas corrosion resistance can be obtained in a highly corrosive well (oil well and gas well) having a high temperature of about 100° C. The lower limit of the effective Cr amount is preferably 8.4%.

V: 0.01 to 1.0%

Vanadium (V) combines with carbon to form fine carbides. This will suppress the formation of Cr carbides, and suppress the occurrence of IGHIC. On the other hand, if the V content is too high, the formation of ferrite is promoted, thereby deteriorating the SSC resistance. Therefore, the V content is not more than 1.0%. The lower limit of the V content is preferably 0.02%, and more preferably 0.03%. The upper limit of the V content is preferably 0.5%, more preferably 0.3%, and further more preferably 0.1%.

Sol. Al: 0.005 to 0.10%

Aluminum (Al) deoxidizes steel. If the Al content is too low, this effect cannot be achieved. On the other hand, if the Al content is too high, the effect is saturated. Therefore, the Al content is 0.005 to 0.10%. The lower limit of the Al content is preferably 0.01%, and more preferably 0.015%. The upper limit of the Al content is preferably 0.08%, more preferably 0.05%, and further more preferably 0.03%. The term Al content as used herein means the content of sol. Al (acid-soluble Al).

The chemical composition of the martensitic Cr-containing steel according to the present invention further contains one or two selected from the group consisting of Mo and W.

Mo: 0 to 2%

W: 0 to 4%

One or two (Mo analogues) selected from the group consisting of molybdenum (Mo) and tungsten (W) suppress the occurrence of IGHIC at minute quantities. However, if the content of Mo analogues is too low, this effect cannot be achieved. On the other hand, the content of Mo analogues is too high, not only this effect is saturated, but also the tempering temperature must be relatively increased to adjust the strength. Further, the raw material cost will increase. Therefore, the content of Mo analogues is 0.03 to 2% in terms of the Mo equivalent defined by Formula (2). For that reason, assuming a case in which either one of them is contained, the Mo content is 0 to 2%, and the W content is 0 to 4%. The lower limit of the Mo equivalent is preferably 0.05%, more preferably 0.10%, and further more preferably 0.20%. The upper limit of the Mo equivalent is preferably 1.5%, more preferably 1.0%, further more preferably 0.8%, and further more preferably 0.5%.

$$\text{Mo equivalent}=\text{Mo}+0.5\times\text{W} \quad (2)$$

where, symbols of elements in Formula (2) are substituted by corresponding contents (by mass %) of the elements.

N: not more than 0.100%

Nitrogen (N) is inevitably contained. N as well as C increases the hardenability of steel, and promotes the formation of martensite. On the other hand, if the N content is too high, this effect is saturated. Further, if the N content is too high, hot rollability of steel is deteriorated. Therefore, the N content is not more than 0.1%. The lower limit of the N content is preferably 0.01%, more preferably 0.020%, and further more preferably 0.030%. The upper limit of the N content is preferably 0.090%, more preferably 0.070%, further more preferably 0.050%, and further more preferably 0.035%.

The balance of the chemical composition of the martensitic Cr-containing steel according to the present invention consists of Fe and impurities. Here, impurities include those which are mixed from ores and scraps as the raw material, or from the production environment when industrially producing steel.

Contents of C, P, S, Ni, and O in the above described impurities are as follows.

C: not more than 0.10%

Carbon (C) is an impurity. If the C content is too high, the formation of Cr carbide is promoted. Cr carbide is likely to act as an initiation site of occurrence of IGHIC. Formation of Cr carbide causes decrease in the effective Cr amount in steel, thereby deteriorating the carbon dioxide gas corrosion resistance of steel. Therefore, the C content is not more than 0.10%. The C content is preferably as low as possible. However, in terms of the cost for decarbonization, the lower limit of the C content is preferably 0.001%, more preferably 0.005%, further more preferably 0.01%, and further more preferably 0.015%. The upper limit of the C content is preferably 0.06%, more preferably 0.05%, further more preferably 0.04%, and further more preferably 0.03%.

P: not more than 0.03%

Phosphorous (P) is an impurity. P segregates at grain boundaries, thereby deteriorating the SSC resistance and the IGHIC resistance of steel. Therefore, the P content is not more than 0.03%. The P content is preferably not more than 0.025%, and more preferably not more than 0.02%. The P content is preferably as low as possible.

S: not more than 0.01%

Sulfur (S) is an impurity. S as well as P segregates at grain boundaries, thereby deteriorating the SSC resistance and the IGHIC resistance of steel. Therefore, the S content is not more than 0.01%. The S content is preferably not more than 0.005%, and more preferably not more than 0.003%. The S content is preferably as low as possible.

Ni: not more than 0.5%

Nickel (Ni) is an impurity. Ni promotes local corrosion, thereby deteriorating the SSC resistance of steel. Therefore, the Ni content is not more than 0.5%. The Ni content is preferably not more than 0.35%, and more preferably not more than 0.20%. The Ni content is preferably as low as possible.

O: not more than 0.01%

Oxygen (O) is an impurity. O forms coarse oxides, thereby deteriorating hot rollability of steel. Therefore, the O content is not more than 0.01%. The O content is preferably not more than 0.007%, and more preferably not more than 0.005%. The O content is preferably as low as possible.

The chemical composition of the martensitic Cr-containing steel of the present invention may further contain, in place of part of Fe, one or more selected from the group consisting of Nb, Ti, and Zr.

Nb: 0 to 1%,

Ti: 0 to 1%,

Zr: 0 to 1%.

Niobium (Nb), titanium (Ti), and zirconium (Zr) are all optional elements, and may not be contained. If contained, each of these elements combines with C and N to form carbonitrides. These carbonitrides refine crystal grains, and suppress the formation of Cr carbides. Thereby, the SSC resistance and the IGHIC resistance of steel are improved. However, if the contents of these elements are too high, the above described effect is saturated, and further the formation of ferrite is promoted. Therefore, the Nb content is 0 to 1%, the Ti content is 0 to 1%, and the Zr content is 0 to 1%. The lower limit of the Nb content is preferably 0.01%, and more preferably 0.02%. The upper limit of the Nb content is preferably 0.5%, and more preferably 0.1%. The lower limit of the Ti content is preferably 0.01%, and more preferably 0.02%. The upper limit of the Ti content is preferably 0.2%, and more preferably 0.1%. The lower limit of the Zr content is preferably 0.01%, and more preferably 0.02%. The upper limit of the Zr content is preferably 0.2%, and more preferably 0.1%.

The chemical composition of the martensitic Cr-containing steel of the present invention may further contain B in place of part of Fe.

B: 0 to 0.01%

Boron (B) is an optional element, and may not be contained. If contained, B increases the hardenability of steel and promotes the formation of martensite. B further strengthens grain boundaries, thereby suppressing the occurrence of IGHIC. However, if the B content is too high, such effect is saturated. Therefore, the B content is 0 to 0.01%. The lower limit of the B content is preferably 0.0003%, and more preferably 0.0005%. The upper limit of the B content is preferably 0.007%, and more preferably 0.005%.

The chemical composition of the martensitic Cr-containing steel of the present invention may further contain, in place of part of Fe, one or more selected from the group consisting of Ca, Mb, and REM.

Ca: 0 to 0.01%,

Mg: 0 to 0.01%,

REM: 0 to 0.50%

Calcium (Ca), Magnesium (Mg), and rare-earth metal (REM) are all optional elements, and may not be contained. If contained, these elements combine with S in steel to form sulfides. This improves the shape of sulfide, thereby improving the SSC resistance of steel. Further REM combines with P in steel, thereby suppressing the segregation of P at grain boundaries. Thereby, deterioration of the SSC resistance of steel attributable to P segregation is suppressed. However, if the contents of these elements are too high, the effect is saturated. Therefore, the Ca content is 0 to 0.01%, the Mg content is 0 to 0.01%, and the REM content is 0 to 0.50%. The term REM as used herein is a general term for a total of 17 elements including Sc, Y and lanthanoide series. When the REM contained in steel is one of these elements, the REM content means the content of that element. When the REM contained in steel is not less than two, the REM content means the total content of those elements.

The lower limit of the Ca content is preferably 0.0001%, and more preferably 0.0003%. The upper limit of the Ca content is preferably 0.005%, and more preferably 0.003%. The lower limit of the Mg content is preferably 0.0001%, and more preferably 0.0003%. The upper limit of the Mg content is preferably 0.004%, and more preferably 0.003%. The lower limit of the REM content is preferably 0.0001%, and more preferably 0.0003%. The upper limit of the REM content is preferably 0.20%, and more preferably 0.10%.

[Micro-Structure (Volume Fraction of Phases)]

In the above described martensitic Cr-containing steel, the micro-structure is mainly composed of tempered martensite. Specifically, the micro-structure consists of, in volume fraction, 0 to 5% of ferrite and 0 to 5% of austenite, with the balance being tempered martensite. If the volume fractions of ferrite and austenite are not more than 5% respectively, variations in strength of steel are suppressed. The volume fractions of ferrite and austenite are preferably as low as possible. More preferably, the micro-structure is a single phase of tempered martensite.

The volume fraction (%) of ferrite in the micro-structure is measured by the following method. The martensitic Cr-containing steel is cut along the rolling direction. The cutting plane (section) at this time includes an axis parallel with the rolling direction and an axis parallel with the rolling-reduction direction. A sample for micro-structure observation including the cutting plane is machined. The sample is embedded in a resin to be mirror polished such that the cutting plane corresponds to the observation surface. After polishing, the observation surface is etched with Villella's solution. Any five visual fields (the area of visual field=150 μm×200 μm) in the etched observation surface are observed with an optical microscope (with an observation magnification of 500 times). This makes it possible to confirm the presence or absence of tempered martensite, ferrite, and austenite.

An area fraction (%) of ferrite in each visual field is measured by a point counting method conforming to JIS G0555 (2003). An average of area fractions of respective visual fields is defined as the volume fraction (%) of ferrite.

The volume fraction of austenite is measured by an X-ray diffraction method. Specifically, a sample is machined from any location of the steel. One surface (observation surface) of the sample surfaces shall be a section parallel with the rolling direction of steel. In the case of the steel pipe, the observation surface is parallel with the longitudinal direction of the steel pipe and perpendicular to the wall thickness direction. The size of the sample is 15 mm×15 mm×2 mm. The observation surface of the sample is polished with an emery paper of #1200. Thereafter, the sample is immersed in hydrogen peroxide of ambient temperature containing a small amount of hydro fluoric acid to remove the work-hardened layer of the observation surface. Thereafter, X-ray diffraction is performed. Specifically, X-ray intensity of each of (200) and (211) planes of ferrite (α phase), and (200), (220), and (311) planes of austenite (γ phase) is measured. Then, integrated intensity of each plane is calculated. After calculation, volume fraction Vγ(%) is calculated by using Formula (3) for combinations (a total of 6 pairs) between each plane of α phase and each plane of γ phase. Then, an average of volume fractions Vγ for 6 pairs is defined as the volume fraction (%) of austenite:

$$V\gamma=100/(I+(I\alpha\times R\gamma)/(I\gamma\times R\alpha)) \quad (3)$$

where, "Iα" and "Iγ" are integrated intensities of α phase and γ phase, respectively. "Rα" and "Rγ" denote scale factors of α phase and γ phase, respectively, and represent values which are theoretically calculated based on crystallography from the plane orientation and the type of substance.

[Micro-structure (Size of Crystal Grain)]

Further, in the micro-structure of the martensitic Cr-containing steel according to the present invention, the grain size number of prior-austenite crystal grain is not less than 8.0. Refining the prior-austenite grain size suppresses the occurrence of IGHIC. The grain size number is measured by a crystal grain size test based on ASTM E112.

[Grain-boundary Segregation Ratio of Mo Analogues]

Further, in the above-described martensitic Cr-containing steel, the grain-boundary segregation ratio of Mo analogues is not less than 1.5. Segregation of Mo analogues at grain boundaries enables the suppression of the occurrence of IGHIC. The grain-boundary segregation ratio of Mo analogues is a ratio of the content of Mo analogues at grain boundaries to the content of Mo analogues within crystal grains. The grain-boundary segregation ratio of Mo analogues is measured by the following method.

A specimen machined from the martensitic Cr-containing steel is used to fabricate a thin film by an electrolytic polishing method. In this case, the thin film contains prior-austenite gain boundaries. With this thin film as an object, the content of each element of Mo analogues is measured by EDS (Energy Dispersive X-ray spectrometry) during electron microscope observation. The electron beam to be used has a diameter of about 0.5 nm. The measurement of the content of each element of Mo analogues is performed at an interval of 0.5 nm on a straight line of 20 nm extending to both sides of a prior-austenite grain boundary. It is arranged such that the straight line perpendicularly intersects with the prior-austenite grain boundary, and the grain boundary passes through the middle of the straight line. For each element of Mo analogues, an average value of contents (by mass %) within the grains and a maximum value thereof on the prior-austenite grain boundary are determined. The average value of the content of each element of Mo analogues within the grains is supposed to be an average value of measured values of three grains arbitrarily selected. The value of the content of each element of Mo analogues within the each grain is measured at the point furthest apart from the grain boundary. The maximum value of the content of each element of Mo analogues at the grain boundary is supposed to be an average value of measured maximum values at three grain boundaries arbitraly selected. The maximum value of the content of each element at the each grain boundary is obtained by the line analysis across the each grain boundary. When Mo analogues includes either one of Mo or W, it is assumed that the grain-boundary segregation ratio is a ratio of a maximum value of the content of the one element at a grain boundary to an average value of the content of the one element within grains. On the other hand, when Mo analogues includes both Mo and W, a ratio of a maximum value of the content at a grain boundary to an average value within grains for each element, and an average value of these ratios is assumed to be the grain-boundary segregation ratio. The grain boundary is assumed to be a boundary between adjoining crystal grains, which is observed as a difference in contrast.

[Strength of Martensitic Cr-containing Steel]

The martensitic Cr-containing steel having the above described chemical composition and micro-structure has a yield strength of less than 379 to 551 MPa (55 to 80 ksi). The yield strength as used herein refers to 0.2% proof stress. Since the yield strength of the steel according to the present invention is less than 551 MPa, the above described steel has excellent SSC resistance. Further, since the yield strength of the steel according to the present invention is not less than 379 MPa, it can be used as OCTG. The upper limit of the yield strength is preferably 530 MPa, more preferably 517 MPa, and further more preferably 482 MPa. The lower limit of the yield strength is preferably 400 MPa, and more preferably 413 MPa. The Rockwell hardness HRC of the above described martensitic Cr-containing steel is preferably not more than 20, and more preferably not more than 12.

[Production Method]

One example of the production method of the above described martensitic Cr-containing steel will be described. The production method of the martensitic Cr-containing steel includes a step of preparing a starting material (preparation process), a step of hot rolling the starting material to produce a steel material (rolling process), and a step of subjecting the steel material to quenching and tempering (heat treatment process). Hereafter, each step will be described in detail.

[Preparation Process]

Molten steel having the above described chemical composition and satisfying Formulae (1) and (2) is produced. The molten steel is used to produce a starting material. Specifically, the molten steel is used to produce a cast piece (slab, bloom, billet) by a continuous casting process. The molten steel may also be used to produce an ingot by an ingot-making process. As needed, a slab, bloom, or ingot may be bloomed to produce a billet. Thus, a starting material (slab, bloom, or billet) is produced by the above described process.

[Rolling Process]

The prepared starting material is heated. The heating temperature is preferably 1000 to 1300° C. The lower limit of the heating temperature is preferably 1150° C.

The heated starting material is hot rolled to produce a steel material. When the steel material is a plate material, hot rolling is performed by using, for example, a rolling mill including pairs of rolls. When the steel material is a seamless steel pipe, piercing-rolling and elongating are performed by, for example, a Mannesmann-mandrel mill process to produce it by using the above described martensitic Cr-containing steel.

[Heat Treatment Process]

The produced steel material is subjected to quenching. If the quenching temperature is too low, dissolution of carbides becomes insufficient. Further, if the quenching temperature is too low, it becomes difficult that Mo analogues homogeneously dissolve. In such a case, segregation of Mo analogues at grain boundaries becomes insufficient. On the other hand, if the quenching temperature is too high, the prior-austenite crystal grain becomes coarse. Therefore, the quenching temperature is preferably 900 to 1000° C. The steel material after quenching is subjected to tempering. If the tempering temperature is too high, segregation of Mo analogues at grain boundaries becomes insufficient. The tempering temperature is preferably 660 to 710° C. The yield strength of the steel material is adjusted to be 379 to less than 551 MPa by quenching and tempering.

The micro-structure of the martensitic Cr-containing steel (steel material) produced by the above described processes consists of, in volume fraction, 0 to 5% of ferrite and 0 to 5% of austenite, with the balance being tempered martensite. That is, the micro-structure is mainly composed of tempered martensite. Moreover, the prior-austenite crystal grain has a grain size number (ASTM E112) of not less than 8.0. Further, the grain-boundary segregation ratio of Mo analogues is not less than 1.5. As a result, excellent carbon dioxide gas corrosion resistance, SSC resistance, and IGHIC resistance are achieved.

EXAMPLES

Molten steels having the chemical compositions shown in Table 1 were produced.

TABLE 1

| Steel | Chemical composition (by mass %, balance being Fe and impurities) | | | | | | | | | | | |
|---|---|---|---|---|---|---|---|---|---|---|---|---|
| Type | C | Si | Mn | P | S | Cr | Ni | Mo | W | sol. Al | V | N |
| A | 0.03 | 0.24 | 0.50 | 0.015 | 0.001 | 9.0 | 0.10 | 0.25 | — | 0.005 | 0.03 | 0.030 |
| B | 0.03 | 0.25 | 0.51 | 0.014 | 0.001 | 9.1 | 0.10 | 0.51 | — | 0.006 | 0.03 | 0.031 |
| C | 0.03 | 0.25 | 0.50 | 0.015 | 0.001 | 9.1 | 0.09 | 1.01 | — | 0.005 | 0.03 | 0.025 |
| D | 0.05 | 0.23 | 0.45 | 0.018 | 0.001 | 11.5 | 0.15 | 0.10 | — | 0.011 | 0.02 | 0.033 |
| E | 0.10 | 0.20 | 0.45 | 0.015 | 0.001 | 9.9 | 0.10 | 1.95 | — | 0.008 | 0.02 | 0.025 |
| F | 0.02 | 0.39 | 0.45 | 0.015 | 0.001 | 10.1 | 0.09 | 0.98 | — | 0.011 | 0.04 | 0.031 |
| G | 0.01 | 0.55 | 0.48 | 0.011 | 0.002 | 9.8 | 0.14 | 1.51 | — | 0.010 | 0.03 | 0.020 |
| H | 0.03 | 0.25 | 0.98 | 0.015 | 0.001 | 10.4 | 0.10 | 0.51 | — | 0.008 | 0.02 | 0.033 |
| I | 0.02 | 0.20 | 0.43 | 0.015 | 0.002 | 9.2 | 0.15 | 0.22 | — | 0.045 | 0.03 | 0.041 |
| J | 0.01 | 0.25 | 0.43 | 0.015 | 0.002 | 8.2 | 0.15 | 0.05 | — | 0.075 | 0.04 | 0.041 |
| K | 0.01 | 0.23 | 0.40 | 0.016 | 0.001 | 9.1 | 0.14 | 0.10 | — | 0.011 | 0.25 | 0.030 |
| L | 0.01 | 0.19 | 0.68 | 0.019 | 0.001 | 9.5 | 0.18 | 0.49 | — | 0.015 | 0.35 | 0.041 |
| M | 0.01 | 0.21 | 0.44 | 0.014 | 0.003 | 9.6 | 0.11 | 1.05 | — | 0.012 | 0.03 | 0.075 |
| N | 0.01 | 0.20 | 0.44 | 0.013 | 0.001 | 9.1 | 0.10 | — | 0.10 | 0.023 | 0.04 | 0.038 |
| O | 0.02 | 0.24 | 0.51 | 0.015 | 0.001 | 9.0 | 0.09 | — | 1.06 | 0.010 | 0.03 | 0.020 |
| P | 0.01 | 0.25 | 0.49 | 0.014 | 0.001 | 10.5 | 0.14 | 0.20 | 0.11 | 0.011 | 0.03 | 0.010 |
| Q | 0.01 | 0.25 | 0.68 | 0.015 | 0.001 | 9.1 | 0.15 | 0.21 | — | 0.010 | 0.02 | 0.033 |
| R | 0.02 | 0.26 | 0.49 | 0.015 | 0.001 | 11.5 | 0.05 | 0.25 | — | 0.012 | 0.03 | 0.028 |
| S | 0.03 | 0.24 | 0.39 | 0.018 | 0.001 | 8.9 | 0.10 | — | 0.64 | 0.010 | 0.02 | 0.033 |
| T | 0.01 | 0.21 | 0.41 | 0.015 | 0.001 | 9.6 | 0.13 | 0.22 | — | 0.012 | 0.03 | 0.030 |
| U | 0.03 | 0.24 | 0.40 | 0.014 | 0.001 | 9.0 | 0.25 | 0.22 | — | 0.012 | 0.02 | 0.025 |
| V | 0.03 | 0.26 | 0.51 | 0.015 | 0.001 | 9.1 | 0.10 | — | 0.56 | 0.008 | 0.04 | 0.033 |
| W | 0.01 | 0.25 | 0.39 | 0.016 | 0.001 | 8.8 | 0.16 | 0.22 | 0.24 | 0.009 | 0.02 | 0.008 |
| X | 0.01 | 0.19 | 0.51 | 0.016 | 0.002 | 9.5 | 0.40 | 0.99 | — | 0.009 | 0.05 | 0.011 |
| Y | 0.01 | 0.26 | 0.43 | 0.016 | 0.001 | 9.1 | 0.15 | 0.51 | — | 0.010 | 0.06 | 0.031 |
| Z | 0.01 | 0.55 | 0.48 | 0.023 | 0.002 | 9.8 | 0.14 | 1.85 | — | 0.010 | 0.03 | 0.020 |
| 1 | 0.01 | 0.20 | 0.45 | 0.015 | 0.001 | 9.1 | 0.15 | 0.22 | 0.43 | 0.034 | 0.03 | 0.030 |
| 2 | 0.21 | 0.25 | 0.51 | 0.020 | 0.002 | 11.5 | 0.18 | 0.20 | — | 0.016 | 0.05 | 0.035 |
| 3 | 0.03 | 0.26 | 2.01 | 0.014 | 0.001 | 10.3 | 0.10 | 0.53 | — | 0.005 | 0.03 | 0.030 |
| 4 | 0.02 | 0.19 | 0.50 | 0.051 | 0.001 | 9.5 | 0.11 | 0.22 | — | 0.010 | 0.03 | 0.033 |
| 5 | 0.03 | 0.24 | 0.54 | 0.018 | 0.011 | 9.2 | 0.15 | 0.58 | — | 0.009 | 0.02 | 0.025 |
| 6 | 0.01 | 0.22 | 0.46 | 0.013 | 0.002 | 7.2 | 0.14 | 0.20 | — | 0.015 | 0.03 | 0.029 |
| 7 | 0.03 | 0.24 | 0.39 | 0.018 | 0.001 | 8.9 | 0.10 | — | — | 0.010 | 0.02 | 0.033 |
| 8 | 0.03 | 0.25 | 0.98 | 0.015 | 0.001 | 10.4 | 0.10 | — | — | 0.008 | 0.02 | 0.033 |
| 9 | 0.05 | 0.20 | 0.49 | 0.012 | 0.001 | 12.5 | 0.16 | 0.21 | — | 0.011 | 0.05 | 0.030 |
| 10 | 0.02 | 0.21 | 0.44 | 0.015 | 0.001 | 10.1 | 0.55 | 0.22 | — | 0.009 | 0.03 | 0.020 |
| 11 | 0.03 | 0.25 | 0.40 | 0.015 | 0.001 | 9.1 | 0.10 | 0.02 | — | 0.011 | 0.02 | 0.030 |
| 12 | 0.07 | 0.21 | 0.48 | 0.012 | 0.001 | 8.3 | 0.11 | 0.21 | — | 0.015 | 0.03 | 0.033 |

| | Chemical composition (by mass %, balance being Fe and impurities) | | | | | | | | Mo | Effective Cr |
|---|---|---|---|---|---|---|---|---|---|---|
| Steel Type | O | Nb | Ti | Zr | B | Ca | Mg | REM (Nd) | equivalent (%) | amount (%) |
| A | 0.001 | — | — | — | — | — | — | — | 0.25 | 8.50 |
| B | 0.002 | — | — | — | — | — | — | — | 0.51 | 8.60 |
| C | 0.001 | — | — | — | — | — | — | — | 1.01 | 8.60 |
| D | 0.005 | — | — | — | — | — | — | — | 0.10 | 10.67 |
| E | 0.004 | — | — | — | — | — | — | — | 1.95 | 8.24 |
| F | 0.003 | — | — | — | — | — | — | — | 0.98 | 9.77 |
| G | 0.004 | — | — | — | — | — | — | — | 1.51 | 9.63 |
| H | 0.003 | — | — | — | — | — | — | — | 0.51 | 9.90 |
| I | 0.003 | — | — | — | — | — | — | — | 0.22 | 8.87 |
| J | 0.004 | — | — | — | — | — | — | — | 0.05 | 8.03 |
| K | 0.003 | — | — | — | — | — | — | — | 0.10 | 8.93 |
| L | 0.003 | — | — | — | — | — | — | — | 0.49 | 9.33 |
| M | 0.004 | — | — | — | — | — | — | — | 1.05 | 9.43 |
| N | 0.004 | — | — | — | — | — | — | — | 0.10 | 8.93 |
| O | 0.001 | — | — | — | — | — | — | — | 1.06 | 8.67 |
| P | 0.002 | — | — | — | — | — | — | — | 0.26 | 10.33 |
| Q | 0.005 | 0.04 | — | — | — | — | — | — | 0.21 | 8.93 |
| R | 0.006 | — | 0.07 | — | — | — | — | — | 0.25 | 11.17 |
| S | 0.005 | — | — | 0.18 | — | — | — | — | 0.64 | 8.40 |
| T | 0.004 | — | — | — | 0.004 | — | — | — | 0.22 | 9.43 |
| U | 0.001 | — | — | — | — | 0.003 | — | — | 0.22 | 8.50 |
| V | 0.001 | — | — | — | — | — | 0.002 | — | 0.56 | 8.60 |
| W | 0.001 | — | — | — | — | — | — | 0.03 | 0.34 | 8.63 |
| X | 0.004 | 0.02 | — | — | 0.002 | — | — | — | 0.99 | 9.33 |
| Y | 0.003 | — | 0.05 | — | — | 0.002 | — | — | 0.51 | 8.93 |
| Z | 0.004 | — | — | — | 0.002 | 0.003 | — | — | 1.85 | 9.63 |
| 1 | 0.005 | 0.03 | — | — | 0.003 | 0.005 | — | — | 0.44 | 8.93 |
| 2 | 0.005 | — | — | — | — | — | — | — | 0.20 | 8.01 |
| 3 | 0.001 | — | — | — | — | — | — | — | 0.53 | 9.80 |
| 4 | 0.003 | — | — | — | — | — | — | — | 0.22 | 9.17 |
| 5 | 0.002 | — | — | — | — | — | — | — | 0.58 | 8.70 |

TABLE 1-continued

| | | | | | | | | | | |
|---|---|---|---|---|---|---|---|---|---|---|
| 6 | 0.003 | — | — | — | — | — | — | — | 0.20 | 7.03 |
| 7 | 0.005 | — | — | — | — | — | — | — | — | 8.40 |
| 8 | 0.003 | — | — | — | — | — | — | — | — | 9.90 |
| 9 | 0.005 | — | — | — | — | — | — | — | 0.21 | 11.67 |
| 10 | 0.003 | — | — | — | — | — | — | — | 0.22 | 9.77 |
| 11 | 0.003 | — | — | — | — | — | — | — | 0.02 | 8.60 |
| 12 | 0.004 | — | — | — | — | — | — | — | 0.21 | 7.13 |

Underline indicates that the specification of the present invention is not satified.

Referring to Table 1, the chemical compositions and effective Cr amounts of Steels A to Z and 1 were within the scope of the present invention. On the other hand, the chemical compositions of Steels 2 to 12 were out of the scope of the present invention. Among those, the Mo equivalent of Steel 11 and the effective Cr amount of Steel 12 were respectively out of the scope of the present invention.

Each of the above descried molten steels was melted in an amount of 30 to 150 kg to form an ingot by an ingot-making process. A block (starting material) having a thickness of 25 to 50 mm was taken from the ingot. The block was heated to 1250° C. The starting material after heating was subjected to hot rolling to produce a plate material (martensitic Cr-containing steel) having a thickness of 15 to 25 mm.

The plate material was subjected to quenching and tempering. The quenching temperature and the tempering temperature were as shown in Table 2. The quenching temperature was varied in a range from 850 to 1050° C. As a result, the prior-austenite grain size was varied. The retention time during quench heating was 15 minutes. The tempering temperature after quenching was varied in a range from 680 to 740° C. As a result, the strength of steel was varied. The retention time for tempering was 30 minutes.

TABLE 2

| Classification | Test Number | steel Type | YS (ksi/MPa) | TS (ksi/MPa) | Quenching Temperature (° C.) | Tempering Temperature (° C.) | Grain Size Number of Prior γ grain | Grain-boundary Segregation Ratio of Mo analogues | SSC Resistance | IGHIC Resistance | Carbonic-gas Corrosion Rate (g/(m$^2$ · h)) |
|---|---|---|---|---|---|---|---|---|---|---|---|
| Inventive Example | 1 | A | 77/530 | 87/599 | 920 | 700 | 9.3 | 2.4 | E | E | 0.25 |
| Inventive Example | 2 | A | 79/544 | 90/620 | 950 | 690 | 8.2 | 1.9 | E | E | 0.25 |
| Inventive Example | 3 | B | 77/530 | 89/613 | 950 | 710 | 8.0 | 2.5 | E | E | 0.26 |
| Inventive Example | 4 | B | 79/544 | 90/620 | 950 | 690 | 8.2 | 2.1 | E | E | 0.26 |
| Inventive Example | 5 | C | 76/524 | 86/592 | 900 | 710 | 10.5 | 2.5 | E | E | 0.23 |
| Inventive Example | 6 | C | 79/544 | 89/613 | 920 | 710 | 9.4 | 2.1 | E | E | 0.26 |
| Inventive Example | 7 | D | 69/475 | 80/551 | 900 | 710 | 9.1 | 2.8 | E | E | 0.05 |
| Inventive Example | 8 | E | 79/544 | 90/620 | 1000 | 700 | 8.5 | 1.5 | E | E | 0.29 |
| Inventive Example | 9 | F | 78/537 | 90/620 | 950 | 700 | 8.2 | 1.6 | E | E | 0.08 |
| Inventive Example | 10 | G | 76/524 | 86/592 | 980 | 700 | 8.0 | 1.5 | E | E | 0.09 |
| Inventive Example | 11 | H | 78/537 | 89/613 | 950 | 710 | 8.2 | 1.7 | E | E | 0.09 |
| Inventive Example | 12 | I | 72/496 | 82/565 | 920 | 710 | 9.5 | 2.0 | E | E | 0.18 |
| Inventive Example | 13 | J | 66/455 | 77/530 | 900 | 710 | 9.8 | 3.1 | E | E | 0.29 |
| Inventive Example | 14 | K | 70/482 | 81/558 | 900 | 700 | 10.4 | 2.5 | E | E | 0.15 |
| Inventive Example | 15 | L | 76/524 | 87/599 | 980 | 710 | 8.0 | 1.8 | E | E | 0.09 |
| Inventive Example | 16 | M | 78/537 | 90/620 | 950 | 700 | 8.2 | 1.6 | E | E | 0.09 |
| Inventive Example | 17 | N | 67/462 | 80/551 | 950 | 710 | 8.1 | 2.6 | E | E | 0.15 |
| Inventive Example | 18 | O | 79/544 | 91/627 | 950 | 680 | 8.3 | 1.2 | E | E | 0.03 |
| Inventive Example | 19 | P | 73/503 | 84/579 | 950 | 710 | 8.3 | 2.5 | E | E | 0.20 |
| Inventive Example | 20 | Q | 76/524 | 77/530 | 1000 | 680 | 9.0 | 2.4 | E | E | 0.16 |
| Inventive Example | 21 | R | 72/496 | 84/570 | 980 | 700 | 9.3 | 2.7 | E | E | 0.03 |
| Inventive Example | 22 | S | 75/517 | 85/586 | 980 | 680 | 9.2 | 2.5 | E | E | 0.25 |

TABLE 2-continued

| Classification | Test Number | steel Type | YS (ksi/MPa) | TS (ksi/MPa) | Quenching Temperature (° C.) | Tempering Temperature (° C.) | Grain Size Number of Prior γ grain | Grain-boundary Segregation Ratio of Mo analogues | SSC Resistance | IGHIC Resistance | Carbonic-gas Corrosion Rate (g/(m$^2$ · h)) |
|---|---|---|---|---|---|---|---|---|---|---|---|
| Inventive Example | 23 | T | 77/530 | 87/500 | 920 | 680 | 9.4 | 2.1 | E | E | 0.11 |
| Inventive Example | 24 | U | 73/503 | 84/579 | 920 | 700 | 9.1 | 2.6 | E | E | 0.25 |
| Inventive Example | 25 | V | 72/496 | 83/572 | 920 | 700 | 9.0 | 2.7 | E | E | 0.26 |
| Inventive Example | 26 | W | 73/503 | 83/572 | 920 | 700 | 9.1 | 2.4 | E | E | 0.25 |
| Inventive Example | 27 | X | 79/544 | 91/627 | 980 | 680 | 8.0 | 1.7 | E | E | 0.09 |
| Inventive Example | 28 | Y | 79/544 | 90/620 | 950 | 680 | 8.2 | 2.1 | E | E | 0.15 |
| Inventive Example | 29 | Z | 77/530 | 87/599 | 1000 | 680 | 8.0 | 1.5 | E | E | 0.10 |
| Inventive Example | 30 | 1 | 78/537 | 89/613 | 920 | 680 | 8.8 | 2.0 | E | E | 0.16 |
| Comparative Example | 31 | B | 77/530 | 88/606 | 1050 | 700 | 7.7 | 2.4 | E | NA | 0.26 |
| Comparative Example | 32 | C | 77/530 | 88/606 | 1050 | 720 | 7.5 | 2.3 | E | NA | 0.25 |
| Comparative Example | 33 | B | 76/524 | 87/599 | 850 | 700 | 10.8 | 1.2 | E | NA | 0.26 |
| Comparative Example | 34 | C | 78/537 | 90/620 | 850 | 720 | 11.0 | 1.0 | E | NA | 0.26 |
| Comparative Example | 35 | B | 51/351 | 72/496 | 920 | 730 | 9.6 | 1.1 | E | NA | 0.26 |
| Comparative Example | 36 | C | 56/386 | 75/517 | 920 | 740 | 10.2 | 1.3 | E | NA | 0.26 |
| Comparative Example | 37 | 2 | 70/482 | 82/565 | 950 | 710 | 8.2 | 2.7 | E | NA | 0.1 |
| Comparative Example | 38 | 3 | 66/455 | 78/537 | 950 | 710 | 8.3 | 3.0 | NA | NA | 0.08 |
| Comparative Example | 39 | 4 | 72/496 | 84/579 | 950 | 710 | 8.2 | 2.8 | NA | NA | 0.13 |
| Comparative Example | 40 | 5 | 69/475 | 81/558 | 950 | 710 | 8.2 | 2.6 | NA | NA | 0.18 |
| Comparative Example | 41 | 6 | 78/537 | 90/620 | 950 | 700 | 8.1 | 2.5 | E | E | 0.65 |
| Comparative Example | 42 | 7 | 73/593 | 84/579 | 900 | 700 | 9.9 | — | E | NA | 0.12 |
| Comparative Example | 43 | 8 | 71/489 | 82/565 | 900 | 700 | 10.3 | — | E | NA | 0.06 |
| Comparative Example | 44 | 9 | 79/544 | 91/627 | 920 | 700 | 9.0 | 2.2 | NA | NA | 0.03 |
| Comparative Example | 45 | 10 | 70/482 | 81/558 | 920 | 710 | 9.1 | 2.8 | NA | NA | 0.08 |
| Comparative Example | 46 | 11 | 72/496 | 83/572 | 900 | 700 | 9.8 | 2.3 | E | NA | 0.12 |
| Comparative Example | 47 | 12 | 77/530 | 87/599 | 950 | 700 | 8.4 | 2.2 | E | E | 0.61 |

Underline indicates that the specification of the present invention is not satisfied (and, for the Carbonic-gas Corrosion Rate, that 0.30 g/(m$^2$ · h) is exceeded).

[Micro-structure Observation Test, and Volume Fraction Measurement Test of Ferrite and Austenite]

Using the plate material after quenching and tempering, a micro-structure observation test was performed by the above described method. As a result, ferrite and martensite were observed in the micro-structure of each test number, and austenite was observed in those of some test numbers as well. The volume fractions (%) of ferrite and austenite in the micro-structure were determined by the above described method. As a result, the volume fractions of ferrite and austenite were respectively not more than 5% in the plate material of any test number. The grain size number (ASTM E112) of prior-austenite crystal grain (denoted as "grain size number of prior-γ grain" in Table 2) was measured as well.

[Grain-boundary Segregation Ratio of Mo Analogues]

Further, the grain-boundary segregation ratio of Mo analogues was determined by the above described method. The determined grain-boundary segregation ratios are shown in Table 2.

[Tensile Testing]

A tensile test specimen was machined from the plate material after quenching and tempering. A round bar tensile test specimen, whose parallel portion had a diameter of 6 mm and a length of 40 mm, was used as the tensile test specimen. The longitudinal direction of this test specimen was arranged to correspond to the rolling direction of the plate material. Using this test specimen, tensile testing at ambient temperature was performed to determine yield strength YS (ksi and MPa) and tensile strength TS (ksi and MPa). The yield strength YS was supposed to be 0.2% proof stress. Resulting yield strength YS and tensile strength TS are shown in Table 2.

[SSC Resistance Evaluation Test]

A round bar test specimen was machined from the plate material of each test number after quenching and tempering. The parallel portion of the round bar test specimen had a diameter of 6.35 mm and a length of 25.4 mm. The longitudinal direction of the round bar test specimen was arranged to correspond to the rolling direction of the plate material.

Using the round bar test specimen, a tensile test was performed in a hydrogen sulfide environment. Specifically, the tensile test was performed conforming to NACE (National Association of Corrosion Engineers) TM 0177 Method A. As a test solution, an aqueous solution which included 5% of salt and 0.5% of acetic acid, and was saturated with 1 atm of hydrogen sulfide gas at ambient temperature (25° C.) was used. A stress corresponding to 90% of actual yield strength was applied to the round bar test specimen immersed in the test solution. If the specimen was broken off within 720 hours while the stress was applied thereto, it was judged to have poor SSC resistance (denoted as "NA" in Table 2). On the other hand, if the specimen was not broken off within 720 hours, it was judged to have excellent SSC resistance (denoted as "E" in Table 2).

[IGHIC Resistance Evaluation Test]

The round bar test specimen after tensile testing was embedded in a resin and mirror-polished such that the longitudinal direction of the test specimen corresponded to the observation surface. A center plane of the stress applying portion of the test specimen was observed at a magnification of 50 to 500 times to confirm the presence or absence of intergranular cracking. If intergranular cracking was present, it was judged that the test specimen had poor IGHIC resistance (denoted as "NA" in Table 2). On the other hand, if intergranular cracking was absent, it was judged that the test specimen had excellent IGHIC resistance (denoted as "E" in Table 2).

[Carbon Dioxide Gas Corrosion Resistance Evaluation Test]

A test specimen (2 mm×10 mm×40 mm) was machined from the plate material of each test number. The test specimen was immersed under no stress in a test solution for 720 hours. As the test solution, a 5% aqueous salt solution of 100° C., which was saturated with carbon dioxide gas at 30 atm, was used. The weight of the test specimen was measured before and after the test. Based on the measured amount of change in weight, corrosion loss of each test specimen was determined. Further, a corrosion rate ($g/(m^2 \cdot h)$) of each test specimen was determined based on the corrosion loss. If the corrosion rate was not more than 0.30 $g/(m^2 \cdot h)$, it was judged that excellent carbon dioxide gas corrosion resistance was achieved.

[Test Results]

Referring to Table 2, the chemical compositions of test numbers 1 to 30 were within the scope of the present invention. Further, the effective Cr amount and Mo equivalent were appropriate as well. As a result, volume fractions of ferrite and austenite were respectively not more than 5% in the micro-structure of each of these test numbers, and the balance of the micro-structure was mainly composed of tempered martensite. Further, the yield strength was appropriate. Furthermore, the grain size number of prior-austenite crystal grain was not less than 8.0. Furthermore, the grain-boundary segregation ratio of Mo analogues was appropriate as well. As a result, the martensitic Cr-containing steels of these test numbers exhibited excellent SSC resistance, carbon dioxide gas corrosion resistance, and IGHIC resistance.

In test numbers 31 and 32, since the quenching temperature was too high, the prior-austenite crystal grain was coarse. As a result, the grain size number of prior-austenite crystal grain was less than 8.0, and IGHIC resistance was low. Nevertheless, SSC resistance was high.

In test numbers 33 and 34, since the quenching temperature was too low, Mo could not be homogenously dissolved, and the grain-boundary segregation ratio of Mo was insufficient. As a result, the IGHIC resistance was low.

In test numbers 35 and 36, since the tempering temperature was too high, the grain-boundary segregation ratio of Mo was insufficient. As a result, the IGHIC resistance was low.

In test number 37, the C content was too high. As a result, the IGHIC resistance was low.

In test number 38, the Mn content was too high. In test number 39, the P content was too high. In test number 40, the S content was too high. As a result, in test numbers 38 to 40, the SSC resistance and the IGHIC resistance were low.

In test number 41, the Cr content and the effective Cr amount were too low. As a result, the carbon dioxide gas corrosion resistance was low. Nevertheless, the SSC resistance and the IGHIC resistance were high.

In test numbers 42 and 43, the chemical compositions except Mo analogues were within the scope of the present invention, and the yield strength was appropriate as well. However, since Mo analogues were not contained, the IGHIC resistance was low.

In test number 44, the Cr content was too high. In test number 45, the Ni content was too high. As a result, in test numbers 44 and 45, the SSC resistance and the IGHIC resistance were low.

In test number 46, the Mo equivalent was too low. As a result, the IGHIC resistance was low. Nevertheless, the SSC resistance and the carbon dioxide gas corrosion resistance were high.

In test number 47, the effective Cr amount was too low. As a result, the carbon dioxide gas corrosion resistance was low. Nevertheless, the SSC resistance and the IGHIC resistance were high.

In the steels of test numbers 1 to 47, the tensile strength was 91 ksi (627 MPa) at the maximum.

So far, embodiments of the present invention have been described. However, the above described embodiments are merely examples for carrying out the present invention. Therefore, the present invention will not be limited to the above described embodiments, and can be carried out by appropriately modifying the above described embodiments within a range not departing from the spirit thereof.

The invention claimed is:

1. A martensitic Cr-containing steel, comprising:

a chemical composition consisting of, by mass %,

Si: 0.05 to 1.00%,

Mn: 0.1 to 1.0%,

Cr: 8 to 12%,

V: 0.01 to 1.0%, sol. Al: 0.005 to 0.10%,

N: not more than 0.100%,

Nb: 0 to 1%,

Ti: 0 to 1%,

Zr: 0 to 1%,

B: 0 to 0.01%,

Ca: 0 to 0.01%,

Mg: 0 to 0.01%, and rare earth metal (REM): 0 to 0.50%, and further consisting of one or two selected from the group consisting of Mo: 0 to 2% and W: 0 to 4%, with the balance being Fe and impurities, wherein the impurities include C: not more than 0.10%, P: not more than 0.03%, S: not more than 0.01%, Ni: not more than 0.5%, and O: not more than 0.01%, and wherein an effective Cr amount defined by Formula (1) is not less than 8%, and an Mo equivalent defined by Formula (2) is 0.03 to 2%;

a micro-structure wherein a grain size number (ASTM E112) of prior-austenite crystal grain is not less than 8.0, and which consists of, in volume fraction, 0 to 5% of ferrite and 0 to 5% of austenite, with the balance being tempered martensite; and a yield strength of 379 to less than 551 MPa, wherein a grain-boundary segregation ratio, which is defined, when either one of Mo and W is contained, as a ratio of a maximum content at grain boundaries to an average content within grains of the contained element, and when Mo and W are contained, as an average of ratios of a maximum content at grain boundaries to an average content within grains of each element, is not less than 1.5:

$$\text{Effective Cr amount} = \text{Cr} - 16.6 \times \text{C} \quad (1)$$

$$\text{Mo equivalent} = \text{Mo} + 0.5 \times \text{W} \quad (2)$$

where, symbols of elements in Formulae (1) and (2) are substituted by corresponding contents (by mass %) of the elements.

2. The martensitic Cr-containing steel according to claim 1, wherein:

the chemical composition contains one or more selected from the group consisting of Nb: 0.01 to 1%, Ti: 0.01 to 1%, and Zr: 0.01 to 1%.

3. The martensitic Cr-containing steel according to claim 1, wherein:

the chemical composition contains B: 0.0003 to 0.01%.

4. The martensitic Cr-containing steel according to claim 2, wherein:

the chemical composition contains B: 0.0003 to 0.01%.

5. The martensitic Cr-containing steel according to claims 1, wherein:

the chemical composition contains one or more selected from the group consisting of Ca: 0.0001 to 0.01%, Mg: 0.0001 to 0.01%, and REM: 0.0001 to 0.50%.

6. The martensitic Cr-containing steel according to claim 2, wherein:

the chemical composition contains one or more selected from the group consisting of Ca: 0.0001 to 0.01%, Mg: 0.0001 to 0.01%, and REM: 0.0001 to 0.50%.

7. The martensitic Cr-containing steel according to claim 3, wherein:

the chemical composition contains one or more selected from the group consisting of Ca: 0.0001 to 0.01%, Mg: 0.0001 to 0.01%, and REM: 0.0001 to 0.50%.

8. The martensitic Cr-containing steel according to claim 4, wherein:

the chemical composition contains one or more selected from the group consisting of Ca: 0.0001 to 0.01%, Mg: 0.0001 to 0.01%, and REM: 0.0001 to 0.50%.

9. Oil country tubular goods, wherein:

the oil country tubular goods are produced using the martensitic Cr-containing steel according to claim 1.

10. Oil country tubular goods, wherein:

the oil country tubular goods are produced using the martensitic Cr-containing steel according to claim 2.

11. Oil country tubular goods, wherein:

the oil country tubular goods are produced using the martensitic Cr-containing steel according to claim 3.

12. Oil country tubular goods, wherein:

the oil country tubular goods are produced using the martensitic Cr-containing steel according to claim 4.

13. Oil country tubular goods, wherein:

the oil country tubular goods are produced using the martensitic Cr-containing steel according to claim 5.

14. Oil country tubular goods, wherein:

the oil country tubular goods are produced using the martensitic Cr-containing steel according to claim 6.

15. Oil country tubular goods, wherein:

the oil country tubular goods are produced using the martensitic Cr-containing steel according to claim 7.

16. Oil country tubular goods, wherein:

the oil country tubular goods are produced using the martensitic Cr-containing steel according to claim 8.

* * * * *